US006790190B2

(12) United States Patent
Marcantoni

(10) Patent No.: US 6,790,190 B2
(45) Date of Patent: Sep. 14, 2004

(54) MASSAGE DEVICE

(75) Inventor: Egidio Marcantoni, Pesaro (IT)

(73) Assignee: Ciar S.P.A., Pesaro (IT)

( * ) Notice: Subject to any disclaimer, the term of this patent is extended or adjusted under 35 U.S.C. 154(b) by 0 days.

(21) Appl. No.: 10/623,837

(22) Filed: Jul. 19, 2003

(65) Prior Publication Data

US 2004/0024335 A1 Feb. 5, 2004

(30) Foreign Application Priority Data

Aug. 1, 2002 (EP) ..... 02017311

(51) Int. Cl.[7] ..... A61H 15/00

(52) U.S. Cl. ..... 601/99; 601/100; 601/102; 601/103

(58) Field of Search ..... 601/24, 86, 87, 601/90, 93, 94, 97, 98, 99, 100, 101, 102, 103, 107, 108, 111, 115, 116, 122, 126, 128

(56) References Cited

U.S. PATENT DOCUMENTS

| | | | | |
|---|---|---|---|---|
| 4,576,149 A | * | 3/1986 | Otuka et al. | 601/99 |
| 5,445,595 A | * | 8/1995 | Chou | 601/118 |
| 6,224,563 B1 | * | 5/2001 | Nonoue et al. | 601/99 |
| 6,443,917 B1 | * | 9/2002 | Canto | 601/99 |
| 6,454,731 B1 | * | 9/2002 | Marcantoni | 601/101 |

* cited by examiner

*Primary Examiner*—Nicholas D. Lucchesi
*Assistant Examiner*—Quang D. Thanh
(74) *Attorney, Agent, or Firm*—Muramatsu & Associates

(57) ABSTRACT

Massage device for an item of furniture for sitting and/or lying on, having a first shaft and a second shaft which are supported parallel with one another in a frame, and having at least one arm which carries at least one massage body, the arm being coupled to the two shafts in such a manner that a rotation of the shafts brings about a massage movement of the massage body in a first and/or second direction. Elements are also provided for displacing the massage body relative to the frame and they are formed by a mechanism for changing the distance between the two shafts.

8 Claims, 4 Drawing Sheets

MASSAGE DEVICE

FIELD OF THE INVENTION

Figure 1:
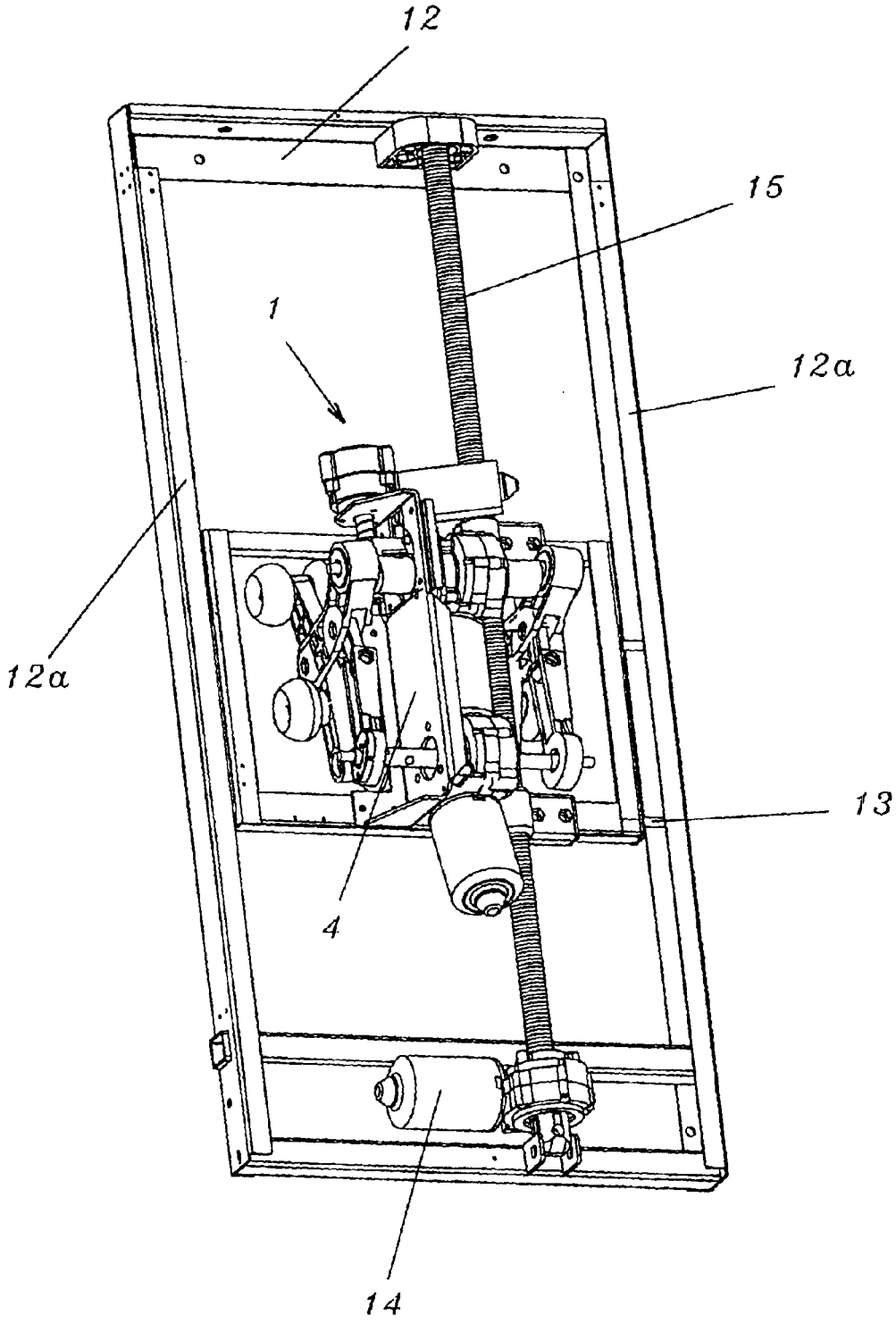

The invention relates to a massage device for an item of furniture for sitting or lying on, having a first shaft and a second shaft which are supported parallel with one another in a frame, and at least one arm which carries at least one massage body. The arm is coupled to the two shafts in such a manner that a rotation of the shafts brings about a massage movement of the massage body in a first and/or second direction.

BACKGROUND OF THE INVENTION

Such massage devices are installed, for example, in the backrest of an armchair. The frame is adjustable in guide rails in the vertical direction so that both the neck region of a user and also the lower back region can be massaged.

Massage armchairs are often used not only for massaging, but also, for example, for reading or watching television. Whereas pressure is to be exerted on the user's back during massage, it is desirable when reading or watching television if the massage body is not felt in the back.

It has therefore already been proposed to form the guide rails, in which the frame can be adjusted in the vertical direction, in such a manner that the massage body is moved away from the user's body at the end of the guide rails. In addition, it has already been proposed to adapt the guide rails to a user's spinal column in the other regions also, in order to exert a correspondingly adapted pressure of the massage body in various regions of a user's back.

EP-A-1 048 281 also discloses a massage device in which the massage body, in addition to the usual kneading or tapping massage, can also be adjusted perpendicularly to the frame. Thus, the massage body can be moved into a resting position in which it no longer exerts pressure on a user's back. This adjustment facility also enables the user to set the pressure of the massage body to his particular requirements. The known embodiment provides that the two shafts are supported together with the drive motors on a slide on the frame, it being possible to adjust the slide by means of a further motor. An adjustment of the slide then brings about a displacement of the two shafts and therefore of the massage bodies relative to the frame.

Although this known embodiment permits very versatile and individual settings, the mechanism requires a relatively large installation space, as a result of which the backrest has to be in a correspondingly thick form.

SUMMARY OF THE INVENTION

The object of the invention is therefore to provide a massage device in which the means for displacing the massage body relative to the frame requires a smaller installation space.

The massage device according to the invention for an item of furniture for sitting and/or lying on consists substantially of a first shaft and a second shaft which are supported parallel with one another in a frame, and at least one arm which carries at least one massage body, the arm being coupled to the two shafts in such a manner that a rotation of the shafts brings about a massage movement of the massage body in a first and second direction. In addition, means are provided for displacing the massage body relative to the frame and they are formed by means for changing the distance between the two shafts.

Owing to the coupling of the arm carrying the massage body to the two shafts, the massage body can be displaced relative to the frame as a result of changing the distance between the shafts by displacing at least one of the two shafts.

According to a preferred embodiment, the arm carries the massage body at one end and is coupled to the first shaft by its other end. Furthermore, the arm is in operative contact with the second shaft in an intermediate region. The rotation of the one shaft brings about a movement of the massage body which takes place substantially parallel with the shaft, while the rotation of the other shaft brings about a movement of the massage body which takes place substantially perpendicularly to the shaft.

According to a special embodiment, the means for changing the distance between the two shafts have a motor for displacing one of the two shafts.

BRIEF DESCRIPTIONS OF THE INVENTION

Figure 2:
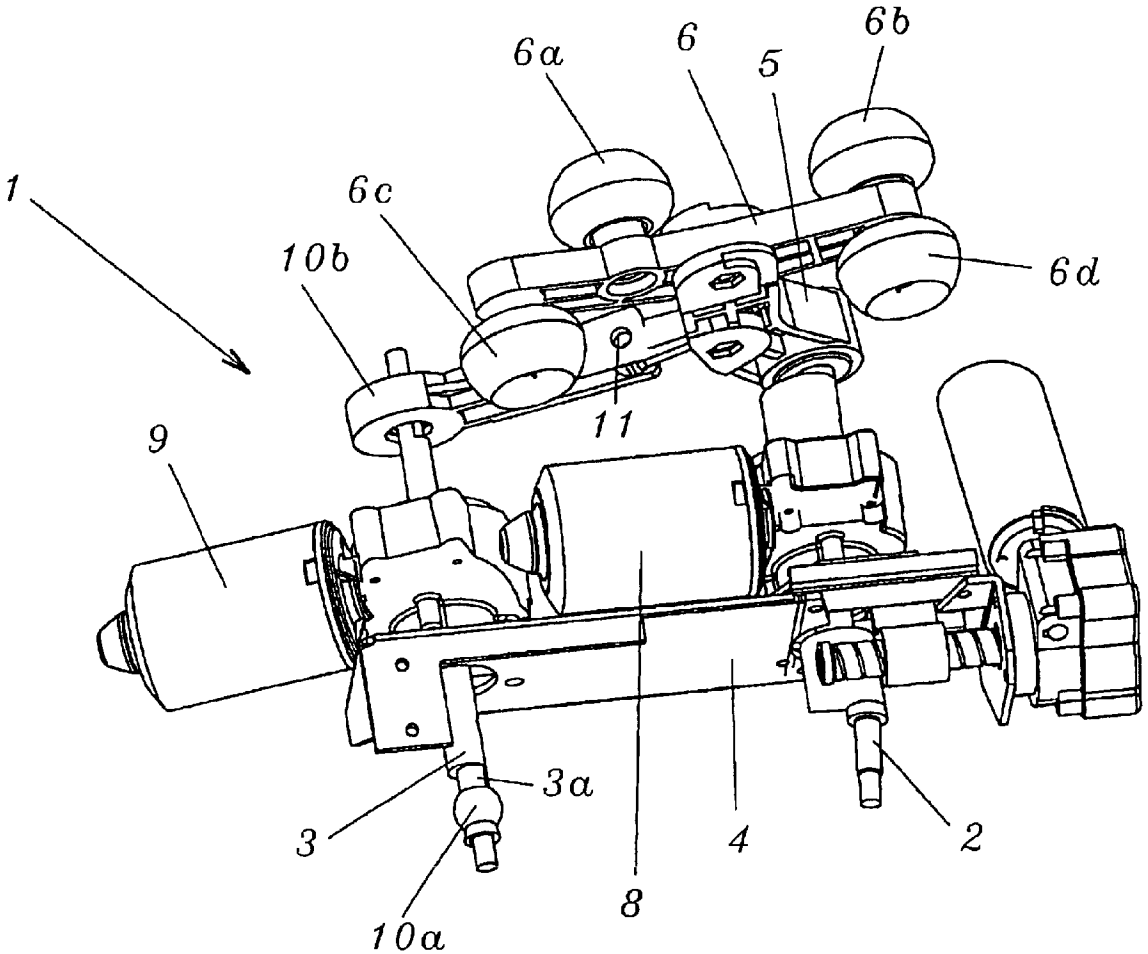
Figure 3:
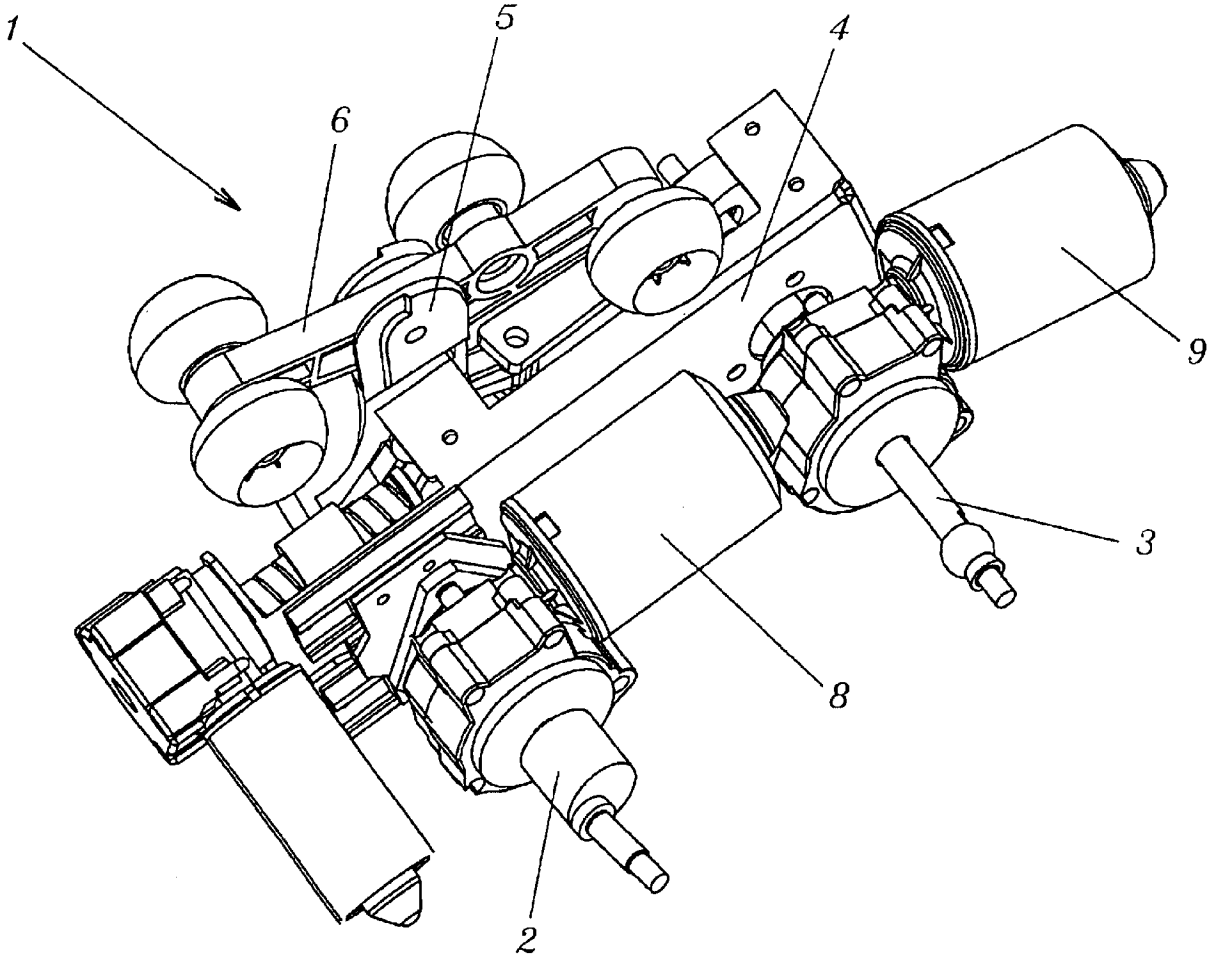
Figures 4, 5:
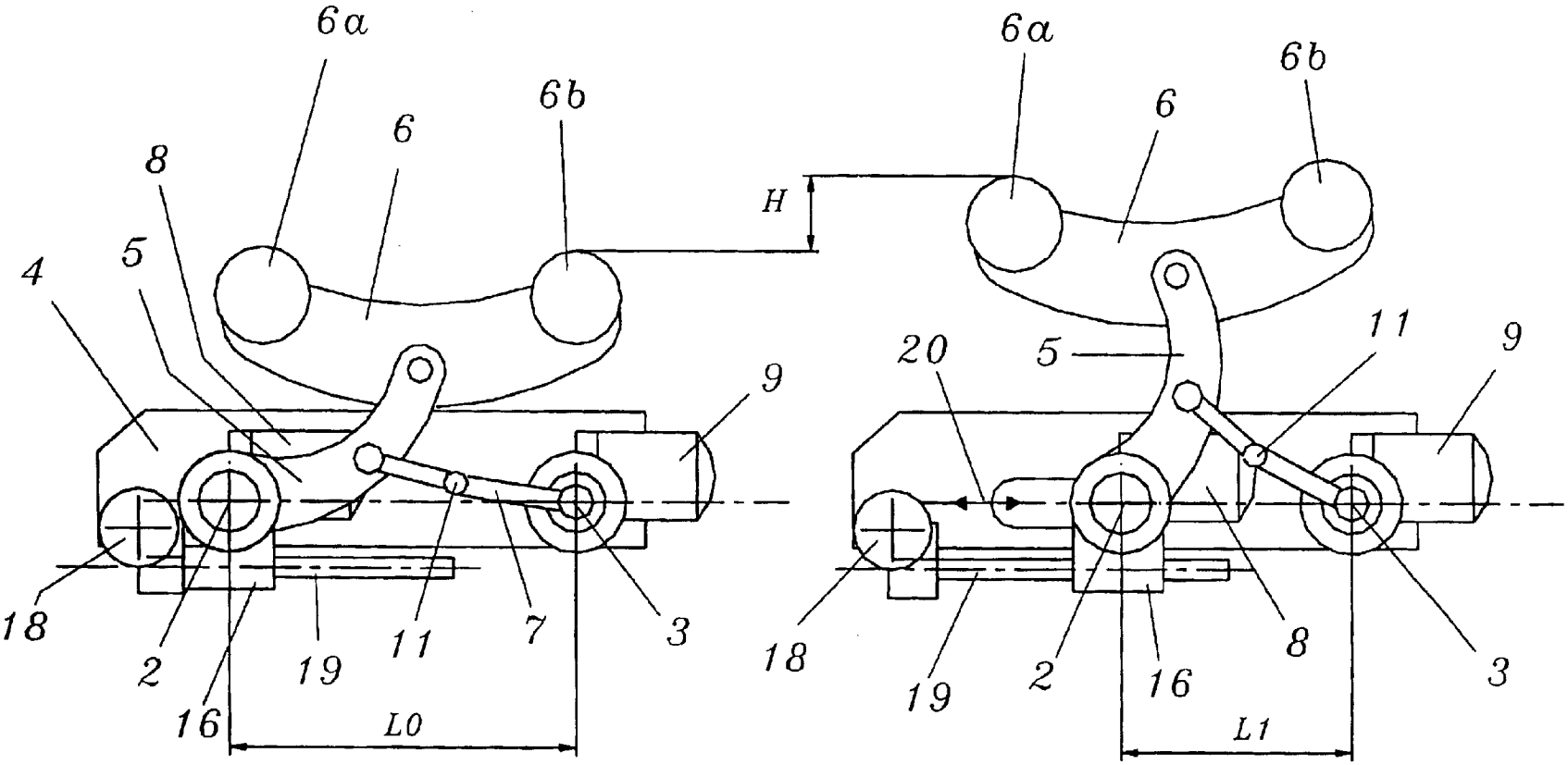

Further advantages and forms of the invention will be explained in more detail hereinafter with reference to the description of an embodiment and the drawings. In the drawings:

FIG. 1 is a perspective view of a massage device installed in a guide frame, FIG. 2 is a perspective view of the massage device from a first viewing angle, FIG. 3 is a perspective view of the massage device from a second viewing angle, FIG. 4 is a diagrammatic side view of the massage device in the resting position, and FIG. 5 is a diagrammatic side view of the massage device in a working position.

DETAILED DESCRIPTION OF THE INVENTION

In the drawings, the massage device according to the invention is marked with the reference sign 1. It consists substantially of a first shaft 2 and a second shaft 3 which are supported parallel with one another in a frame. An arm 5 carries a massage body 6 at its one end and is coupled to the first shaft 2 by its other end. In a central region, the arm is also in operative contact with the second shaft 3 by way of a linkage 7.

The first shaft 2 is driven by means of a first gear motor 8 and the second shaft 3 is driven by means of a second gear motor 9.

In the case of the embodiment shown in the Figures, the massage device has two arms 5, for the sake of clarity only one arm 5 being shown in FIGS. 2 and 3. The second arm would be in operative contact with the free ends of the shafts 2 and 3.

The type of coupling of the arm 5 to the shaft 2 or 3 determines the type of movement transmitted onto the massage body by the rotation of the shaft. In the embodiment shown, the ends of the shaft 2 are slightly angled relative to the shaft axis so that the rotation of the shaft 2 brings about a movement of the massage body which takes place substantially parallel with the shaft 2.

The coupling of the arm 5 to the second shaft 3 by way of the linkage 7 is effected by way of an eccentric portion 3*a* which, when the shaft 3 rotates, brings about a movement of the massage body which takes place substantially perpendicularly to the shaft 3.

The movement of the massage body caused by the shaft 3 is normally referred to as tapping massage while the movement based on the rotation of the first shaft 2 is referred to as stroking massage. In operation, the two massage movements can of course also be superposed on one another.

The linkage 7 is connected to the second shaft 3 by a ball-and-socket joint 10*a*, 10*b* and also comprises two portions which are so connected to one another in the central region by an articulation 11 that they can be pivoted about an axis which extends substantially perpendicularly to the second shaft 3. This linkage on the one hand enables the tapping movement to be transmitted onto the massage body 6 perpendicularly to the shaft 3 and, on the other hand, permits the movement parallel with the shafts brought about by the first shaft 2.

For as compact an arrangement of the massage device as possible, it is especially advantageous if the two gear motors 8, 9 are connected to the two shafts in a central region thereof.

In the embodiment shown, the massage body 6 is formed by a carrier which is supported pivotably on the arm 5 and on which several massage rollers 6*a*–6*d* are arranged. Instead of massage rollers, it is, however, also possible to use balls or other massage bodies.

FIG. 1 shows the installation situation of the massage device 1 in a guide frame 12 which is arranged, for example, in the backrest of a massage chair. The guide frame 12 provides lateral rails 12*a* in which the frame 4 of the massage device can be moved up and down, for example by way of rollers 13. The movement of the massage device 1 in the guide frame 12 is effected by means of a spindle 15 driven by a motor 14.

By activating the motor 14, the massage device 1 can be moved up and down in the guide frame along the spindle 15. As that happens, the massage bodies 6 exert pressure on the back of the person sitting in the massage chair. However, the person also feels the massage bodies when they are not in action. Since, however, this greatly impairs comfort, the massage device 1 described above provides means for bringing the massage body into a resting position in which the massage body does not exert pressure on a person's back.

Those means are explained in more detail hereinafter with reference to FIGS. 4 and 5.

According to the invention, it is provided that one of the two shafts 2, 3 be supported displaceably on the frame 4 while the other shaft is fitted in a stationary manner. In the embodiment shown, the second shaft 3 is supported on the frame 4 in a stationary manner while the first shaft 2 is arranged to be displaceable. For that purpose, the first shaft 2 is mounted on a slide 16 which is moveable to-and-fro by a spindle driven by a motor 18 (double arrow 20).

In the embodiment shown, the displacement of the first shaft 2 takes place in the plane containing the two shafts 2, 3.

In the resting position according to FIG. 4, the shafts 2, 3 are at a distance L0 from one another while the distance in a working position according to FIG. 5 is shortened to L1. Owing to the fact that the arm 5 is articulated pivotably at its one end to the first shaft 2 and the arm is also coupled to the second shaft 3 by way of the linkage 7, a displacement of the first shaft 2 brings about a pivoting of the arm 5 relative to the frame 4. However, a pivoting of the arm 5 also brings about a displacement of the massage body 6 relative to the frame 4. Between the resting position according to FIG. 4 and the working position according to FIG. 5, the massage body 6 is displaced relative to the frame 4 by the amount H.

The motor 8 is coupled to the first shaft 2 and is therefore displaced as well. Of course, in addition to the resting position, not just one but any desired number of working positions is possible within the scope of the invention. For example, the motor 18 could be activated in a specific manner when the frame 4 is displaced in the guide frame 12. Thus, the massage body 6 can be specifically adapted to the shape of a user's spinal column. The pressure of the massage body could also be altered in specific positions of the frame 4.

Owing to the fact that the first shaft 2 with its associated motor 8 is displaced in the same plane in which the second shaft 3 with its associated motor 9 is arranged, an extremely compact structural unit is obtained which requires less installation space than the solutions known hitherto.

Although the invention is described herein with reference to the preferred embodiments, one skilled in the art will readily appreciate that various modifications and variations may be made without departing from the spirit and the scope of the present invention. Such modifications and variations are considered to be within the purview and scope of the appended claims and their equivalents.

What is claimed is:

1. Massage device (1) for an item of furniture for sitting and/or lying on, having a. a first shaft (2) and a second shaft (3) which are supported parallel with one another in a frame (4), b. at least one arm (5) which carries at least one massage body (6), c. the arm being coupled to the two shafts in such a manner that a rotation of the shafts brings about a massage movement of the massage body in a first and/or second direction, d. and means for displacing the massage body relative to the frame, characterized in that e. the means for displacing the massage body relative to the frame are formed by means (16, 18, 19) for changing the distance between the two shafts.

2. Massage device according to claim 1, characterized in that the arm (5) carries the massage body (6) at one end and is coupled to the first shaft (2) at the other end.

3. Massage device according to claim 1, characterized in that the arm (5) carries the massage body (6) at one end and is coupled to the first shaft (2) at the other end, and the arm is also in operative contact with the second shaft (3) in a central region.

4. Massage device according to claim 1, characterized in that the rotation of the one shaft (2) brings about a movement of the massage body (6) which takes place substantially parallel with the shaft, while the rotation of the other shaft brings about a movement of the massage body which takes place substantially perpendicularly to the shaft.

5. Massage device according to claim 1, characterized in that one of the two shafts (2, 3) is supported displaceably on the frame.

6. Massage device according to claim 1, characterized in that the means for changing the distance between the two shafts comprise a motor (18) for displacing one of the two shafts.

7. Massage device according to claim 1, characterized in that the arm (5) carries the massage body (6) at one end and is connected in an articulated manner to the first shaft (2) at the other end and, in an intermediate region, the arm (5) is also in operative contact with the second shaft (3) by way of a linkage (7).

8. Massage device according to claim 1, characterized in that the two shafts (2, 3) are driven independently of one another by means of a respective gear motor (8, 9).

* * * * *